US007150377B2

(12) United States Patent
Cook et al.

(10) Patent No.: US 7,150,377 B2
(45) **Date of Patent: *Dec. 19, 2006**

(54) BULK CONTAINER ASSEMBLY

(75) Inventors: Matthew R. Cook, Hinsdale, IL (US); Barry Silverstein, Northbrook, IL (US); Kurt Wolf, Evanston, IL (US)

(73) Assignee: LBP Manufacturing Inc., Cicero, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/804,466

(22) Filed: Mar. 19, 2004

(65) Prior Publication Data

US 2005/0023330 A1 Feb. 3, 2005

Related U.S. Application Data

(63) Continuation of application No. 10/151,385, filed on May 17, 2002, now Pat. No. 6,736,289.

(51) Int. Cl.
*B65D 35/56* (2006.01)

(52) U.S. Cl. ..... 222/105; 229/103.11

(58) Field of Classification Search ..... 220/495.01, 220/495.03, 495.05, 62, 601, 676; 222/105, 222/183, 321.7, 383.1, 185.1, 130; 229/117.3, 229/117.35, 103.11, 185.1; 206/784
See application file for complete search history.

(56) References Cited

U.S. PATENT DOCUMENTS 1,778,248 A * 10/1930 Doughty ..... 222/132
2,134,865 A * 11/1938 Essery ..... 222/130
3,054,549 A 9/1962 Leslie
3,944,127 A 3/1976 Bruke et al.
4,401,239 A 8/1983 Thomassen
4,541,526 A 9/1985 Berg et al.
4,653,252 A 3/1987 van de Haar et al.
4,673,125 A 6/1987 Weaver
4,781,314 A 11/1988 Schoonover et al.
5,004,123 A 4/1991 Stoody
5,050,775 A * 9/1991 Marquardt ..... 222/93
5,092,486 A 3/1992 vom Hofe et al.
5,133,497 A 7/1992 Küppersbusch
5,163,485 A 11/1992 Hermann
5,228,589 A * 7/1993 Della Riva ..... 206/229
5,353,982 A 10/1994 Perkins et al.
5,356,029 A 10/1994 Hogan
5,454,483 A * 10/1995 Ichikawa et al. ..... 220/737
5,526,958 A 6/1996 Küppersbusch
5,562,227 A 10/1996 Takezawa et al.
5,566,851 A 10/1996 Sasaki et al.
5,673,817 A 10/1997 Mullen et al.

(Continued)

FOREIGN PATENT DOCUMENTS

GB 2228725 A * 5/1990

*Primary Examiner*—Lien M. Ngo
(74) *Attorney, Agent, or Firm*—Brinks Hofer Gilson & Lione

(57) ABSTRACT

A substance container may be used for containing substances such as liquids or powders. The container assembly includes a body. The body contains a bag to contain the substance. At least a portion of the side walls of the body may include a double panel thickness to add strength to the container assembly. A first aperture located on the body to accommodate a dispensing assembly. A second aperture is also located on the body to accommodate a filling assembly. While the filling assembly is located near a top of the body, it does not protrude past a plane represented by a top surface of the body.

12 Claims, 9 Drawing Sheets

U.S. PATENT DOCUMENTS 5,746,350 A 5/1998 Nishigami et al.
5,750,216 A 5/1998 Horino et al.
5,806,981 A * 9/1998 Schisler ..... 383/38
5,830,548 A * 11/1998 Andersen et al. ..... 428/36.4
6,024,252 A 2/2000 Clyde
6,053,401 A 4/2000 Andrews, Sr.
6,062,431 A 5/2000 Geshay
6,138,902 A 10/2000 Welch
6,170,715 B1 1/2001 Evans
6,189,736 B1 2/2001 Phallen et al.
6,196,452 B1 3/2001 Andrews, Sr. et al.
6,253,993 B1 7/2001 Lloyd et al.
6,290,124 B1 9/2001 Andrews, Sr. et al.
6,293,432 B1 9/2001 Hartwell
6,439,757 B1 * 8/2002 Lloyd ..... 366/130
6,443,329 B1 9/2002 Rochefort et al.
6,736,289 B1 * 5/2004 Cook et al. ..... 222/105
6,755,324 B1 * 6/2004 Geshay ..... 222/1

* cited by examiner

BULK CONTAINER ASSEMBLY

RELATED APPLICATION

This application is a continuation of U.S. patent application Ser. No. 10/151,385, filed May 17, 2002, now U.S. Pat. No. 6,736,289 entitled "BULK CONTAINER ASSEMBLY," which is hereby incorporated by reference herein.

FIELD OF THE INVENTION

The invention relates to containers, and more specifically to portable substance containers that may be intended to contain liquids and powders, and that may be disposable.

BACKGROUND

Portable containers are widely used by a variety of industries to store substances and to allow substances to be transported from one location to another. For example, the catering industry uses containers to transport food and beverages, often in large quantities, from preparation or storage areas to an event. The food containers are often disposable and therefore may be thrown away after the event. Therefore, after the event, the food containers do not have to be returned to the caterer or picked up by the caterer.

Many known beverage containers used by caterers, however, are not disposable. Therefore, the caterer must return to the place of the event, after the event ends, to retrieve the emptied beverage containers. Many known disposable beverage containers are either too small for the catered events or not robust enough to contain large amounts of the beverage over a long period of time. The non-robust containers can tip over or buckle under the weight of the beverage. Moreover, many known disposable beverage containers are difficult for the user to fill and/or empty. Therefore, there is a need for a container assembly that may be disposable, may be robust enough to contain large amounts of a substance, easy to operate and/or maintain its shape for a substantial period of time.

BRIEF SUMMARY

The article described herein is a container that may be shipped flat, later assembled, used to store substances such as liquids or powders, and to allow the substances to be transported. The substance container may be manufactured from corrugated packaging and may be disposable. The substance container may be used by catering companies and/or for take-out or for in store dispensing of beverages. The container may also be used to contain substances such as alcohol, soda, water, juices, cooking or motor oil, liquid or powdered chemicals and detergents.

The container includes a body. The body may be insulated, for example, with foil. The body encases a bag which is used to contain the substance. At least a portion of side walls of the body may include a double panel thickness to add strength to the container assembly. A dispensing assembly fits through a first aperture located on the body. A second aperture is located on the body to accommodate a filling assembly. The filling assembly is located near a top of the body, but it does not protrude past a plane represented by a top surface of the body. The container assembly may also include a cavity to contain or receive a cup for the dispensing of beverages and/or to hold accoutrements such as packets of cream and stirrers.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views. In the drawings.

DETAILED DESCRIPTION

Figure 1:
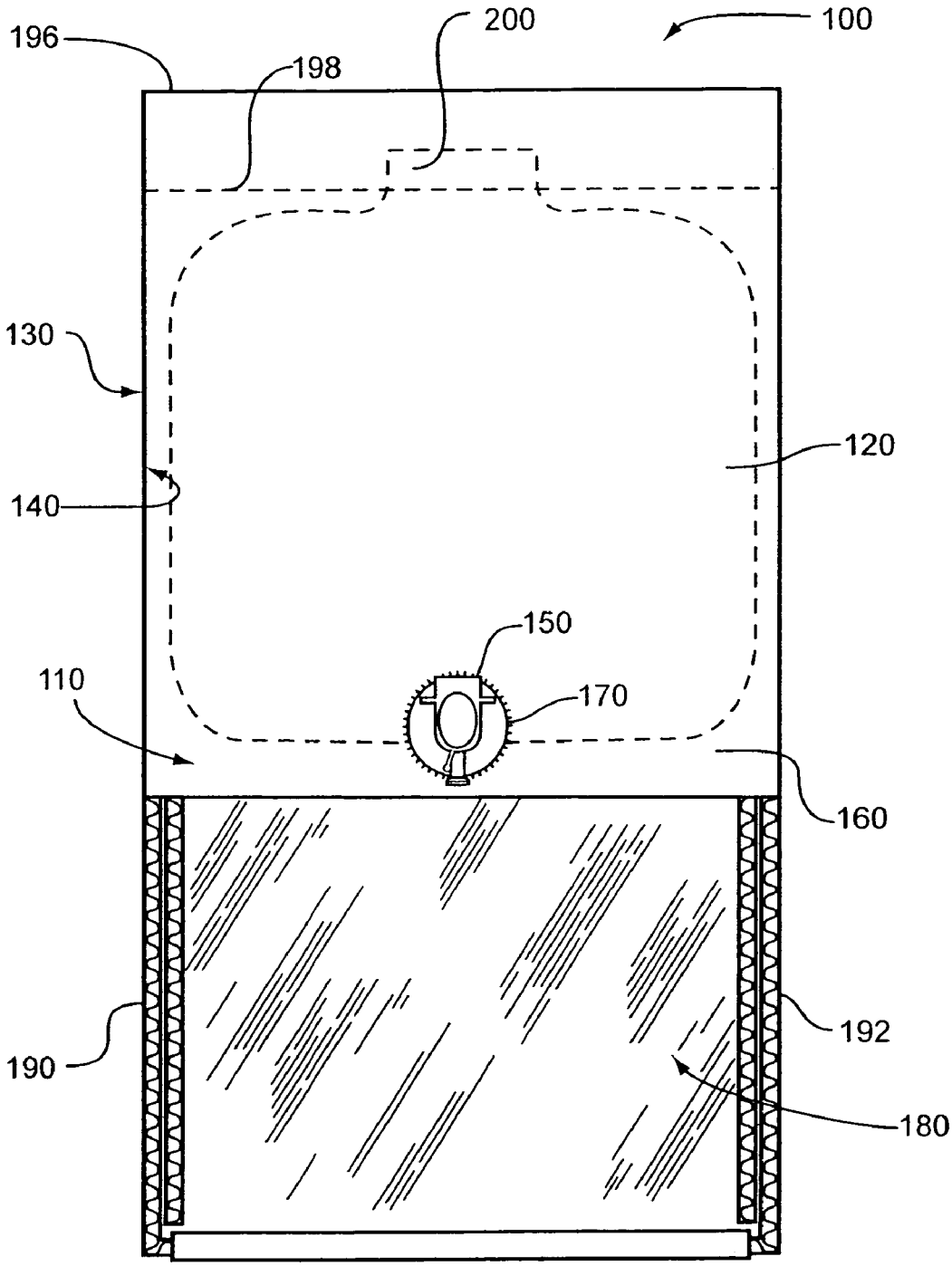
FIG. 1 is a front view of a schematic illustrating a substance container.

FIG. 1 is a front view of a schematic illustrating a substance container 100. The substance container 100 includes a body 110 that may be manufactured using a disposable material such as corrugated packaging, which includes single or double walled corrugated cardboard, paperboard and corrugated plastic. Those skilled in the art will appreciate that other materials may be used for the body 110 such as fluted plastics. Located within the body 110, the substance container 100 includes a bag 120 (shown best in FIG. 3) that may be used to hold substances such as liquids or powders.

The substance container 100 may be used for the transportation or storage of substances. The substance container 100 may be implemented in a variety of manners, for example, for the take-out or in-store dispensing of substances and/or for catering. For example, the substance container 100 may contain liquids such as hot or cold beverages including coffee, alcohol, soda, carbonated beverages, water and juices. The substance container 100 may also contain other liquids such as oils, soaps or liquid chemicals used by a variety of industries. The substance container 100 may also contain other substances including powders such as powdered soaps, detergents and chemical agents. The substance container 100 may also contain food additives, powders and concentrates, such that when liquids such as water or milk, are added and mixed with the substance, foods or beverages may result, such as sports drinks, hot chocolate, flavored drinks, soups and sodas.

An outer surface 130 of the body 110 may include marketing indicia. To market the contained substance, the substance container 100 may include advertising or logos that promote the sale of the product located within the substance container 100. For example, a coffee salesman could deliver samples of coffee to perspective customers using a substance container 100 with the name and logos of the coffee maker printed on the substance container 100. Moreover, a salesperson could advertise a product unrelated to the substance contained within the substance container 100. For example, the salesperson could provide coffee to perspective customers or a focus group using a substance container 100 that includes the logos and marks of the salesperson's company, for example, an insurance company.

To maintain the contained substance, such as coffee, at a certain temperature over a period of time, an interior surface 140 of the body 110 of the substance container 100 may include insulation such as metalized polyester or foil. The metalized polyester or foil may be laminated or otherwise affixed to the interior surface 140 of the substance container 100. In addition, the thickness of the bag 120 used to contain the substance and/or a fluting caliper of the corrugated material of the body 110 can be varied to help insulate the substance for varying durations.

Figure 2:
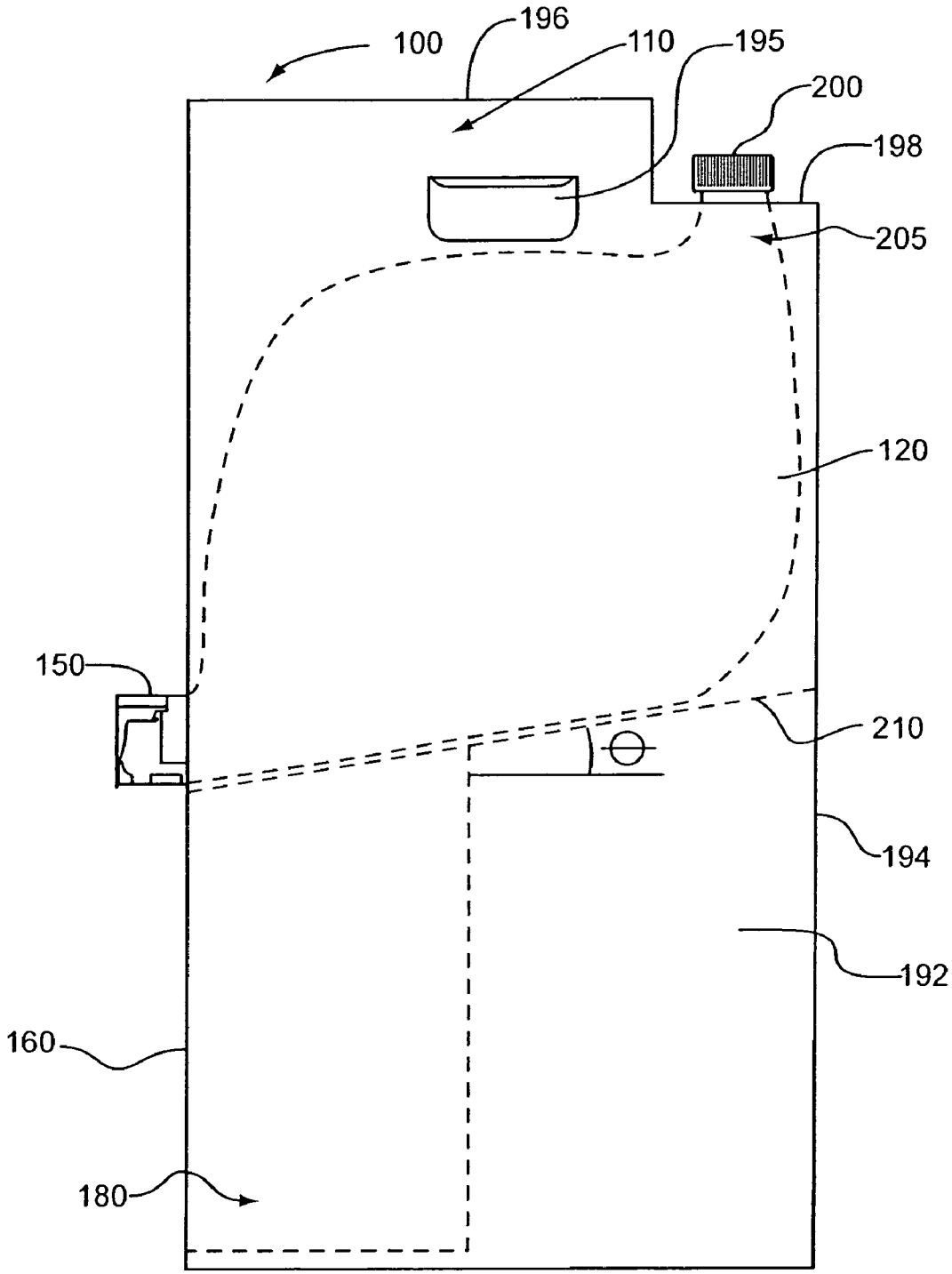
FIG. 2 is a side view of a schematic illustrating the substance container.

FIG. 2 is a side view of a schematic illustrating the substance container. Referring to FIGS. 1 and 2, to dispense substances to a user, the substance container 100 may include a dispensing assembly 150. The dispensing assembly 150 may include an open/close mechanism to controllably dispense substances to the user. The dispensing assembly 150 may protrude beyond a surface of a front panel 160 through an aperture 170 located in the front panel 160.

Below the dispensing assembly 150, a cavity 180 is formed between side panels 190, 192 with an opening in the front panel 160. The cavity 180 may extend as far back as a rear panel 194. The cavity 180 may not extend the full width of the front panel 160. Approximately one-inch strips of the front panel 160 remain around the cavity 180 to add stability. The cavity 180 may provide room for a cup being filled under the spout or the storage of items such as sugar, cream and stirrers.

The side walls 190, 192 may include a double panel thickness to provide strength and stability to a structure of the substance container 100. The double panel thickness is created by folding over the sidewalls 190, 192, as described in more detail below. The substance container 100 may also include apertures 195 located on the side panels 190, 192 that operate as handles to allow the substance container 100 to be carried.

The top panel of the substance container 100 may include an top surface 196 and a recessed surface 198. The bag 120, or at least a portion of it, such as a filling assembly 200, may extend upwardly above the recessed surface 198 though an aperture 205. The filling assembly 200 allows the bag 120 to be filled with substances such as liquids or powders. The bag 120 rests on a bottom support 210. By way of example, coffee may be poured through the filling assembly 200 into the bag 120. The coffee may then be dispensed through the dispensing assembly 150. To aid in the dispensing of the coffee from the bag 120, the bottom support 210 may be positioned at an angle θ inclined towards the dispenser unit 150.

Figure 3:
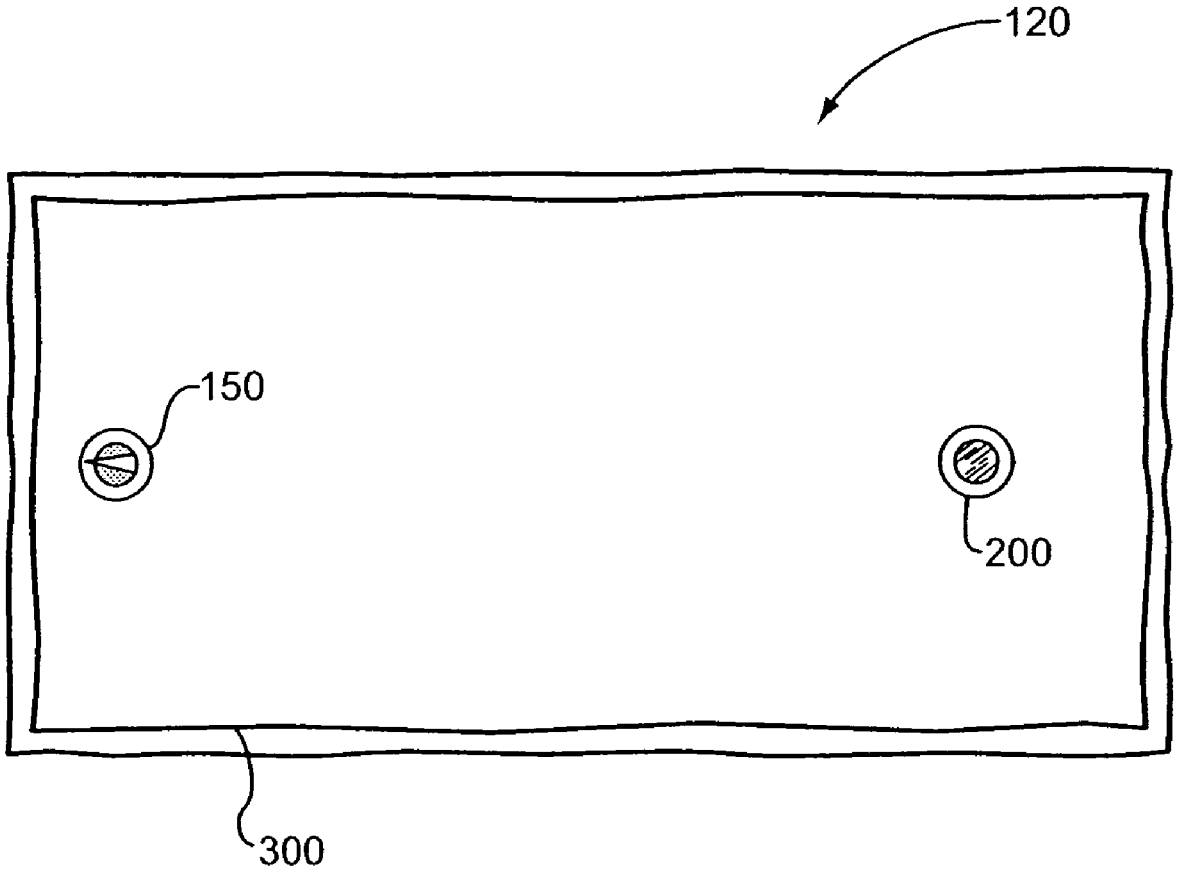
FIG. 3 is plan view of a bag that may be used with the substance container.

FIG. 3 is plan view of a bag 120 that may be used with the substance container 100. Exemplary bag types include a bag 120 manufactured from a two ply polyethylene that contains two fitments, such as the dispensing assembly 150 and the filling assembly 200. The filling assembly 200 includes a 38 MM screw spout with a 38 MM screw cap. Other filling assemblies 200 may be used such as a filling assembly that includes a snap-on cap or a check valve that opens when the bag 120 is being filled and automatically closes with the bag 120 is not being filled. The filling assembly 200 may also include a tamper resistant mechanism. An exemplary dispensing assembly 150 includes a Waddington & Duval spout and hi-flow press tap. Those skilled in the art will appreciate that other dispensing assemblies 150 may be used such as a pump described below in FIG. 12.

By way of example, various types of film structures may be used to manufacture the bag 120 such as metalized polyester/linear low density polyethelyne, metalized polyester/metalized polyester, metalized polyester/polyethylene, EVOH/metalized polyester, EVOH/polyethylene, NYLON/polyethylene, NYLON/NYLON, NYLON/EVOH, NYLON/metalized polyester, BARRIER ICE, BARRIER ICE/polyethylene, and metalized polyester/BARRIER ICE. By way of example, testing parameters of the bag 120 may include a minimum test duration of three hours, heat retention testing, a taste test, such as with coffee or tea, material and product compatibility, perimeter seal integrity, fitment assembly seal integrity, fitment hot product integrity and ease of use.

By way of example, in a three and five gallon capacity application, an exemplary bag size includes 27 inches I.D. in length and 18½ inches I.D. in width with the fitments located 8⁷⁄₁₆ inches from the edge of the bag 120 along the width. The bag 120 can include a one piece assembly or two or more pieces sealed together using a perimeter heat seal 300 or other type of sealing mechanism. Those skilled in the art will appreciate that the bag size can be changed without interfering with the type of fitments used or the placement location of the fitments to the bag 120. Those skilled in the art will appreciate that other bag types or other mechanisms other than those described could also be used with the substance container 100.

Figure 4:
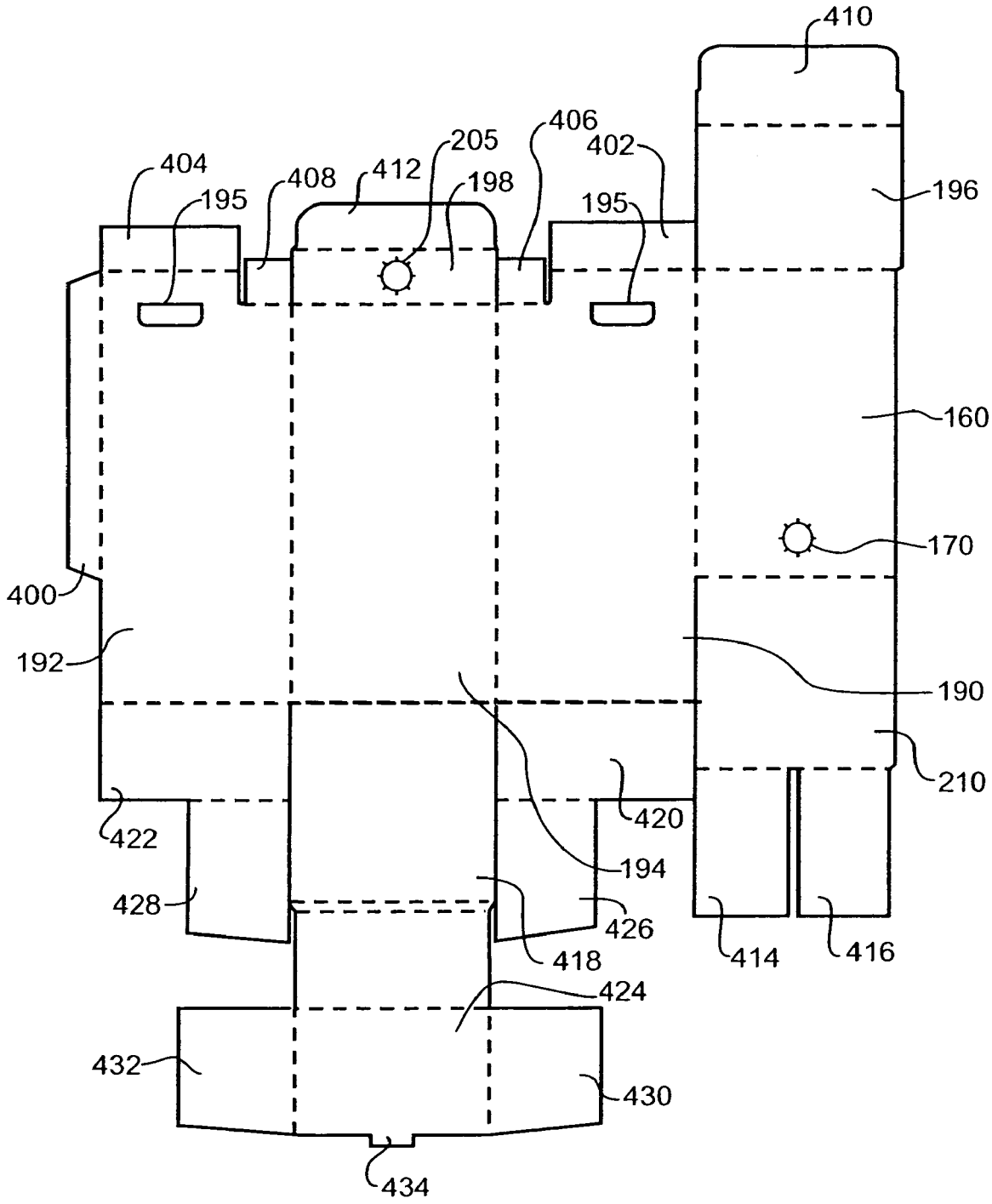
FIG. 4 is a plan view of a blank from which the substance container may be assembled.

FIG. 4 is a plan view of the substance container 100 in its fold-flat configuration. The substance container 100 may be shipped flat for ease of shipping. Fold lines of the substance container 100 are shown in dashed lines. The substance container 100 includes the front panel 160, side panels 190, 192 and rear panel 194. A glue tab 400 extends along side panel 192. When the substance container 100 is partially assembled in a fold-flat configuration for shipping, shown best in FIG. 6, the tab 400 is affixed, such as by gluing, to an interior surface of the front panel 160. The side panels 190, 192 include apertures 195 that may be used as handles for the assembled substance container 100.

The side panels 190, 192 include tabs 402 and 404 respectively, which fold to provide stability the top surface 196 of the top panel. Likewise, the side panels 190, 192 include tabs 406 and 408 respectively, which fold to provide support to the recessed surface 198 of the top panel. The top surface 196 includes a tab 410 that folds to form a surface perpendicular to the recessed surface 198 when the substance container 100 is assembled. The recessed surface 198 includes a tab 412 that folds to abut the tab 410 when the substance container 100 is assembled (shown best in FIG. 11).

To support the bag 120, the substance container 100 includes the bottom support 210. The bottom support 210 folds towards rear panel 194. The bottom support 210 includes flaps 414, 416 that fold to abut the rear panel 194 to form a double panel thickness at the rear panel 194. The rear panel 194 includes bottom panel 418 that folds to create a bottom surface of the substance container 100. The side panels 190, 192 include flaps 420 and 422 respectively, which fold to abut the bottom panel 418 (shown best in FIG. 9).

To complete the bottom surface and cavity 180 of the substance container 100, the bottom panel 418 includes a cavity back panel 424 that include flaps that include flaps 426 and 428. The cavity back panel 424 folds to create a back surface for the cavity 180. The cavity back panel 424 may also be eliminated and the rear panel 194 of the substance container 100 may be used as the back surface of the cavity 180. Flaps 420, 422 further include flaps 426 and 428 respectively, which fold to create a support for the cavity back panel 424 (shown best in FIG. 9). The cavity back panel 424 further includes flaps 430 and 432 that fold to abut side panels 190, 192 to create a double panel thickness for the side surfaces. The double panel thicknesses may create extra support for the substance container 100. The cavity back panel 424 may also include a tab 434 that fits into a slot (not shown) of the bottom panel 418 to help maintain a position of the cavity back panel 424.

Figure 5:
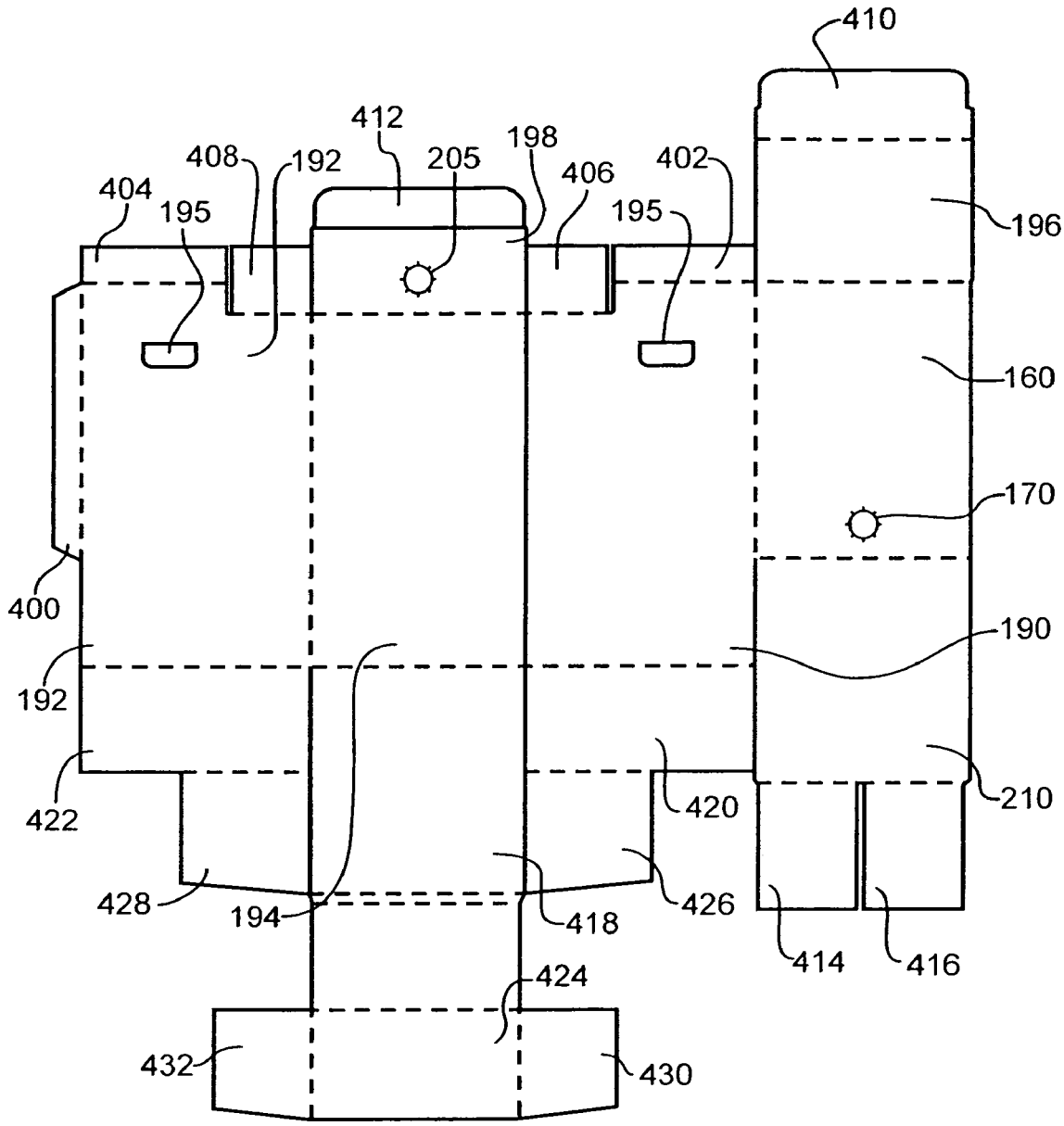
FIG. 5 is a plan view of another blank of a substance container.

FIG. 5 is a plan view of another blank of the substance container 100. The blank shown in FIG. 5 is a larger version of the blank shown in FIG. 4. By way of example, the blank shown in FIG. 4 includes a width of 36⅛ inches from the left most edge to the right most edge, and a length of 48 3/16 inches from the top most edge to the bottom most edge. A substance container 100 constructed from the blank in FIG. 4 may accommodate three gallons of a liquid. The blank shown in FIG. 5 includes a width of 46⅛ inches from the left most edge to the right most edge, and a length of 53 9/16 inches from the top most edge to the bottom most edge. A substance container 100 constructed from the blank in FIG. 5 may accommodate five gallons of a liquid.

Figure 6:
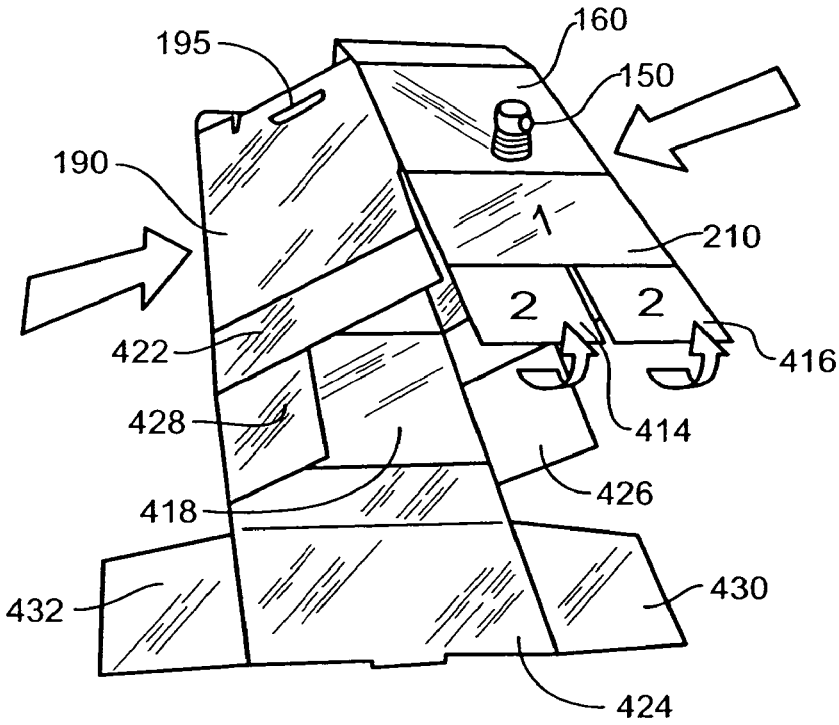
FIG. 6 is a perspective view of the substance container in a fold-flat configuration, according to a step of an assembly process.

FIG. 6 is a perspective view of the substance container 100 in a fold-flat configuration, according to a first step of an assembly process. The substance container 100 is assembled by folding the above-described blanks along determined lines. Initially, the substance container 100 is positioned into a generally three-dimensional rectangle.

Figure 7:
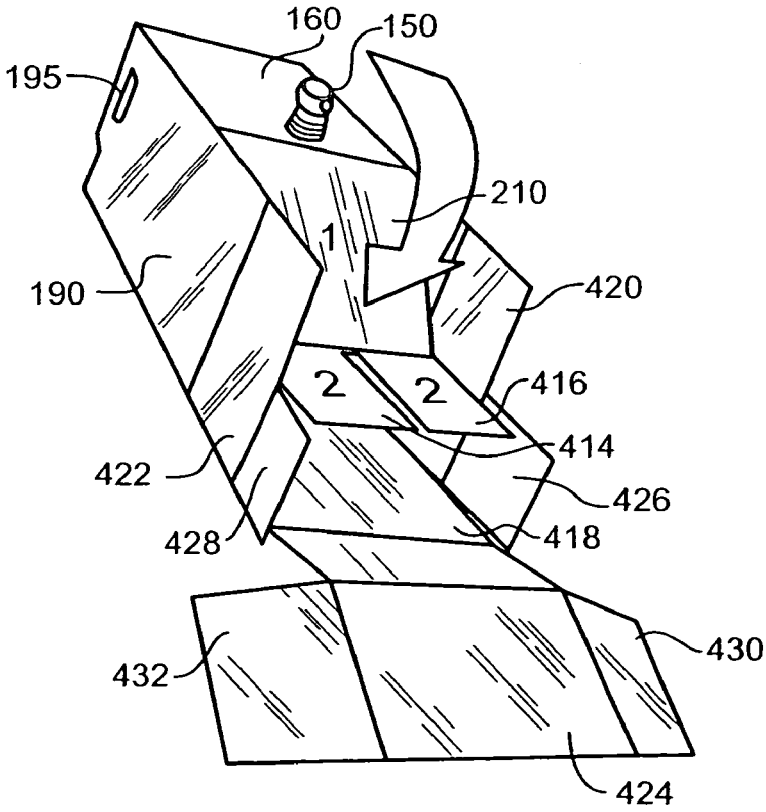
FIG. 7 is a perspective view of the substance container according to a step of the assembly process.

FIG. 7 is a perspective view of the substance container 100 according to another step of the assembly process. The bottom support 210 is folded towards the rear panel 194 and the flaps 414, 416 are folded to abut the rear panel 194. Once the substance container 100 is fully assembled, the flaps 414, 416 position the bottom support 210, for example at an inclined angle θ (FIG. 2), and sustain a position of the bottom support 210.

Figure 8:
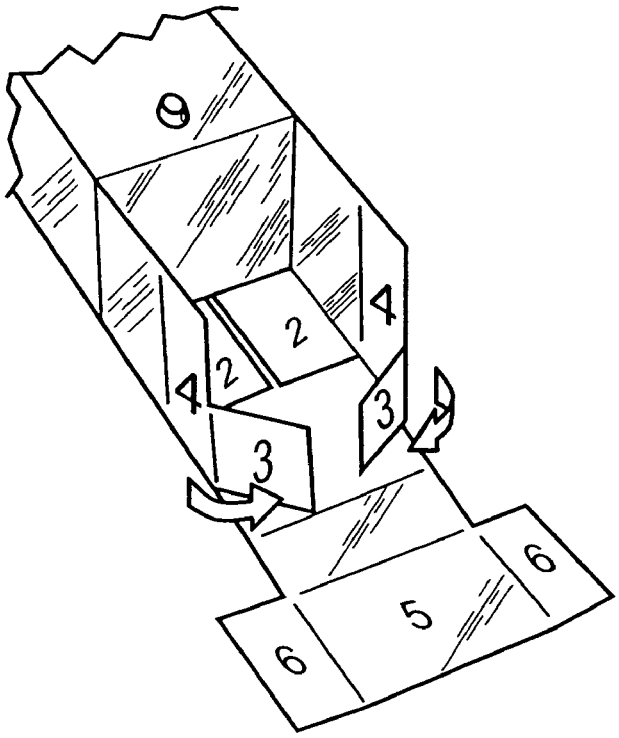
FIG. 8 is a perspective view of the substance container according to a step of the assembly process.
Figure 9:
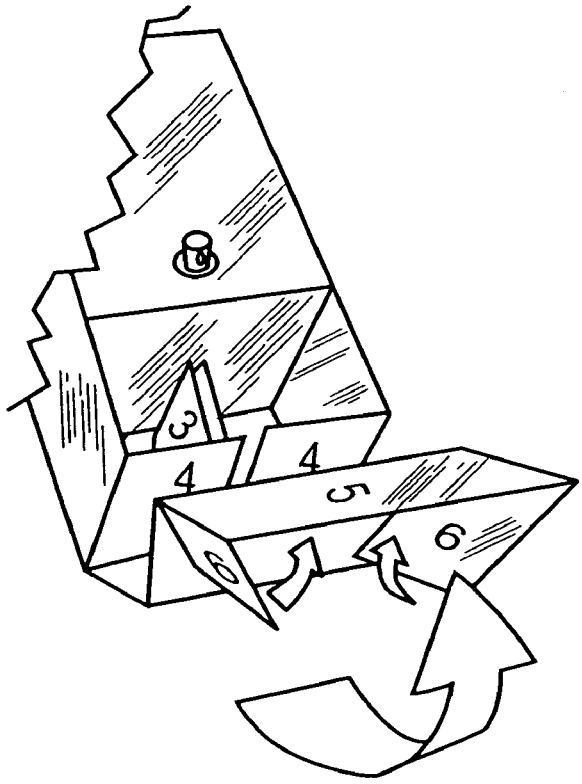
FIG. 9 is a perspective view according to step of the assembly process.

FIGS. 8 and 9 are perspective views of the substance container 100 according to other steps of the assembly process. When the bottom support 210 and flaps 414, 416 are positioned, flaps 420, 422 are folded parallel to a bottom surface of the substance container 100 and flaps 426, 428 are folded up to form a support for the cavity back panel 424. The cavity back panel 424 is folded up to abut an edge of the flaps 426, 428.

Figure 10:
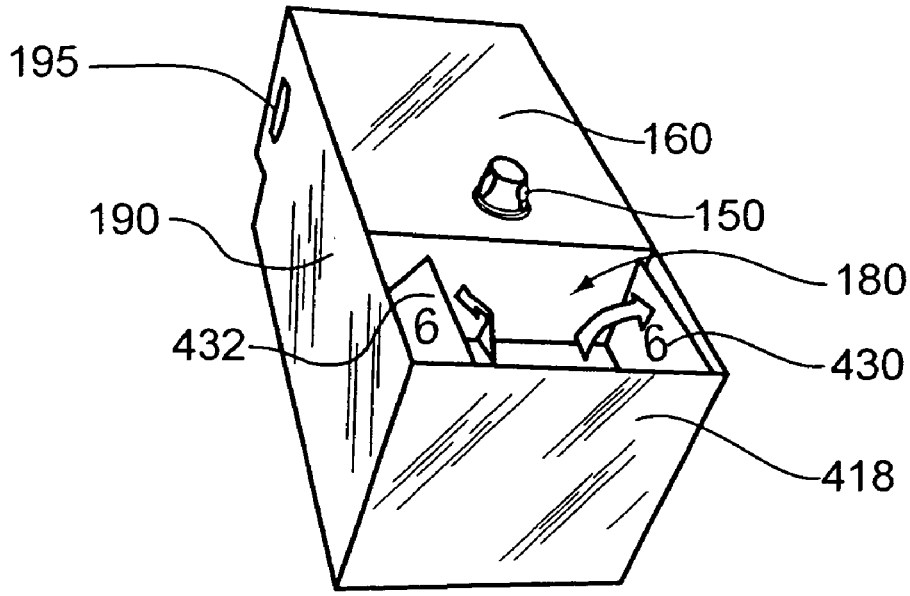
FIG. 10 is a perspective view according to a step of the assembly process.

FIG. 10 is a perspective view according to another step of the assembly process. Flaps 430, 432 are folded over to abut the side panels 190, 192, to create a double panel thickness. With the bottom portion of the substance container completely assembled, the cavity 180 is formed.

Figure 11:
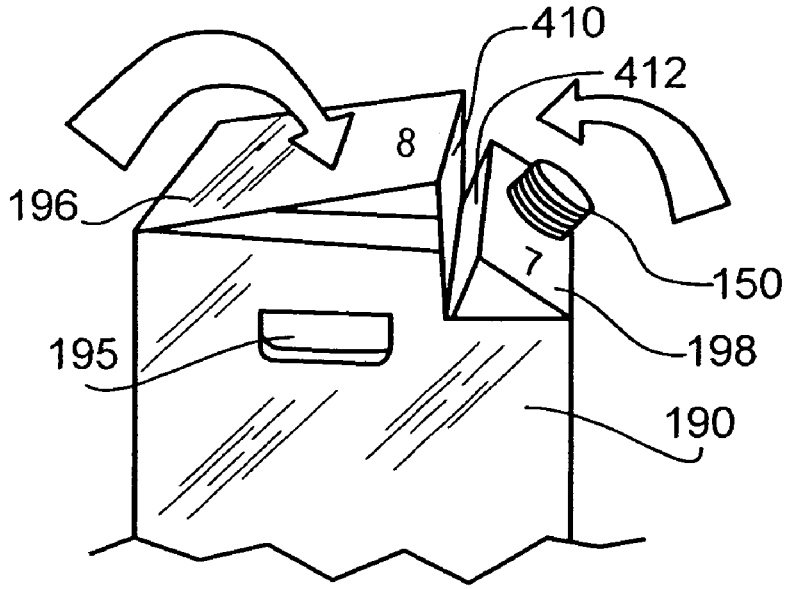
FIG. 11 is a perspective view according to a step of the assembly process.

FIG. 11 is a perspective view according to another step of the assembly process. To complete a top portion of the substance container 100, top surface 196 and recessed surface 198 are folded over and tucked in by folding down flaps 410, 412 to abut each other. After the top portion of the substance container 100 is assembled, the filling assembly 150 is located below a plane of the top surface 196. The recessed portion of the top of the substance container 100 allows for a pleasant appearance and for the substance containers 100 to be stacked.

Figure 12:
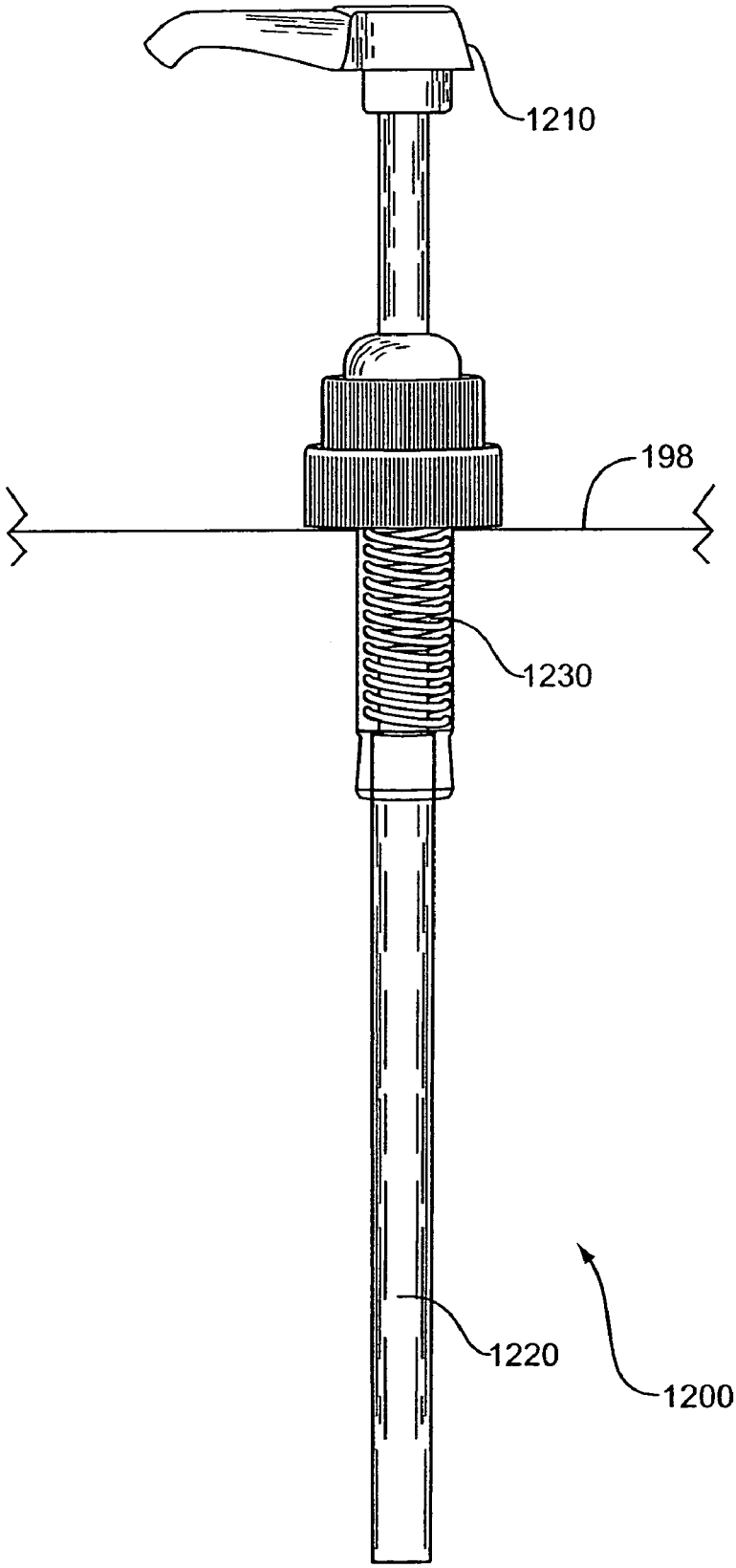
FIG. 12 is a partial side view of the substance container including a pump.

FIG. 12 is a partial side view of the substance container 100 including a pump 1200. The pump 1200 may include a dispenser unit 1210 and a tube 1220 to dispense substance from the substance container 100 to the user. By way of example, the pump 1200 is pushed in to release the substance from the tube 1220. The pump 1200 may also include a spring 1230 to automatically push the pump 1200 out after it has been pushed in. As the pump 1200 is pushed out, the substance is drawn from inside the bag 120 to the tube 1220 of the pump 1200. Therefore, the pump 1200 may be pushed in again to release more substance, and the spring pushes the pump 1200 out when the pump is disengaged. This process may be repeated as desired. Those skilled in the art will appreciate that a variety of types of pumps could be used and that the pumps may be located at different locations on the substance container 100, depending on the design of pump. For example, the pump 1200 may be located at the top of the substance container 100, such as at aperture 205, or on a side of the substance container 100, such as at aperture 170.

While various embodiments of the invention have been described, it will be apparent to those of ordinary skill in the art that may more embodiments and implementations are possible that are within the scope of the invention.

We claim:

1. A substance container comprising: a body comprising a corrugated packaging, the body including a first side panel, a second side panel located opposite from the first side panel, a front panel and a rear panel extending between the first side panel and the second side panel, wherein the front panel includes an aperture for accommodating a dispensing assembly, wherein the first side panel, the second side panel, and the rear panel of an assembled body form a cavity fully accessible from an opening in the front panel without opening a panel, wherein the opening of the cavity is located below the aperture when the body is positioned upright, and wherein the cavity is capable of accommodating at least a portion of a cup.

2. The substance container of claim 1 wherein at least a portion of the first side panel and the second side panel includes a double panel thickness.

3. The substance container of claim 1 further including a support positioned between the first side panel and the second side panel.

4. The substance container of claim 3 wherein the support is capable of buttressing a bag above the cavity.

5. The substance container of claim 1 wherein the corrugated packaging comprises corrugated cardboard.

6. The substance container of claim 1 wherein the cavity is configured to contain beverage cups.

7. The substance container of claim 1 further including a bottom panel extending between the first side panel, the second side panel and the rear panel to form part of the cavity.

8. A container for containing substances, the container comprising: a body including a first side panel, a second side panel, a front panel, a rear panel, and a top panel, wherein the top panel includes a top surface and a recessed surface wherein a first aperture is located in the front panel and accommodates a dispensing assembly; a filling assembly located at the recessed portion of the top panel, wherein the filling assembly does not protrude past a plane represented by the top surface of the top panel; and wherein the first side panel, the second side panel, and the rear panel form a cavity accessible from the front side panel without dissembling the body, wherein an opening of the cavity is located below the first aperture when the body is positioned upright, and wherein the cavity can accommodate at least a portion of a cup.

9. The container of claim 8 further including a dispensing assembly positionable with the first aperture.

10. The container of claim 9 wherein the dispensing assembly comprises a pump.

11. The container of claim 8 wherein the body comprises a corrugated packaging.

12. The container of claim 11 wherein the corrugated packaging comprises corrugated cardboard.

* * * * *